US011022123B2

(12) United States Patent
Schaafsma

(10) Patent No.: US 11,022,123 B2
(45) Date of Patent: Jun. 1, 2021

(54) TRANSFER PUMP AND TRANSFER PUMP ACCESSORY

(71) Applicant: TTI (MACAO COMMERCIAL OFFSHORE) LIMITED, Macau (MO)

(72) Inventor: Graham M. Schaafsma, Raleigh, NC (US)

(73) Assignee: TTI (MACAO COMMERCIAL OFFSHORE) LIMITED, Macau (MO)

( * ) Notice: Subject to any disclaimer, the term of this patent is extended or adjusted under 35 U.S.C. 154(b) by 79 days.

(21) Appl. No.: 16/282,796

(22) Filed: Feb. 22, 2019

(65) Prior Publication Data

US 2019/0264693 A1 Aug. 29, 2019

Related U.S. Application Data

(60) Provisional application No. 62/634,411, filed on Feb. 23, 2018.

(51) Int. Cl.
*F04D 15/00* (2006.01)
*F04D 15/02* (2006.01)

(52) U.S. Cl.
CPC ..... *F04D 15/0011* (2013.01); *F04D 15/0209* (2013.01)

(58) Field of Classification Search
CPC .. F04D 15/0011; F04D 15/02; F04D 15/0209; F04C 14/06; F04C 14/08
See application file for complete search history.

(56) References Cited

U.S. PATENT DOCUMENTS 3,183,839 A * 5/1965 Brunson ..... F04C 14/26 417/300
3,739,761 A 6/1973 Niles
3,801,228 A 4/1974 Mueller
4,248,258 A 2/1981 Devitt et al.
4,396,353 A 8/1983 MacDonald
(Continued)

FOREIGN PATENT DOCUMENTS

CN 206726031 * 12/2017
EP 1184568 B1 11/2004

OTHER PUBLICATIONS

Flowmeter for large-scale pipes, by Guo Chu-wen, Wu Nan-nan and Xia Shuang (Year: 2009).*

*Primary Examiner* — Woody A Lee, Jr.
*Assistant Examiner* — Brian O Peters
(74) *Attorney, Agent, or Firm* — Michael Best & Friedrich LLP

(57) ABSTRACT

A transfer pump includes a housing defining an inlet and an outlet. A main pump path and a bypass path disposed between the inlet and the outlet. A motor is in fluid communication with the main pump path and is configured to be energized to move a fluid through the main pump path and the bypass path. The fluid movement being indicative of a non-siphoning condition occurring between the inlet and the outlet. A flow sensor is disposed in fluid communication with the bypass path and being configured to generate a flow rate signal indicative of a flow rate of fluid in the bypass path. A controller in communication with the flow sensor for receiving the flow rate signal and being configured to de-energize the motor when the flow rate signal satisfies a first flow rate threshold indicative of a siphoning condition occurring between the inlet and the outlet.

15 Claims, 6 Drawing Sheets

(56) References Cited

U.S. PATENT DOCUMENTS

| | | | | |
|---|---|---|---|---|
| 5,704,767 | A * | 1/1998 | Johnson | F04C 11/00 417/43 |
| 5,860,790 | A | 1/1999 | Wang | |
| 8,191,566 | B2 * | 6/2012 | Donahue | C12M 37/04 137/68.23 |
| 8,763,625 | B1 | 7/2014 | Carter | |
| 8,967,250 | B2 * | 3/2015 | Lisk | E21B 43/128 166/250.03 |
| 2004/0000346 | A1 | 1/2004 | Lin | |
| 2006/0144439 | A1 | 7/2006 | Bell | |
| 2017/0030371 | A1 | 2/2017 | Wilds et al. | |

* cited by examiner

TRANSFER PUMP AND TRANSFER PUMP ACCESSORY

CROSS REFERENCE TO RELATED APPLICATIONS

This application claims priority to U.S. Provisional Patent Application No. 62/634,411 filed Feb. 23, 2018, the entire contents of which are incorporated herein by reference.

BACKGROUND

The present subject matter relates to a transfer pump for the transfer of a fluid, such as water, from one location to another location. Typically, a motorized pump is used to aid the transfer of the fluid.

SUMMARY

In one embodiment, a transfer pump is disclosed. A transfer pump includes a housing defining an inlet and an outlet. A main pump path disposed between the inlet and the outlet. A bypass path disposed between the inlet and the outlet. A motor in fluid communication with the main pump path. The motor being configured to be energized to move a fluid through the main pump path and the bypass path. The fluid movement being indicative of a non-siphoning condition occurring between the inlet and the outlet. A flow sensor disposed in fluid communication with the bypass path, the flow sensor being configured to generate a flow rate signal indicative of a flow rate of fluid in the bypass path. A controller in communication with the flow sensor for receiving the flow rate signal. The controller being configured to de-energize the motor when the flow rate signal satisfies a first flow rate threshold indicative of a siphoning condition occurring between the inlet and the outlet.

In another embodiment, a method of operating a transfer pump is disclosed. The method includes providing a pump being configured to transfer a fluid through a primary channel and a bypass channel, the pump including a motor being configured to transfer the fluid through the primary channel. Determining a flow rate associated with the fluid being transferred through the primary channel or the bypass channel. De-energizing the motor to discontinue the transfer of the fluid through the primary channel based on the flow rate satisfying a first flow rate threshold.

In yet another embodiment, a transfer pump accessory is disclosed. The transfer pump accessory includes a first fitting configured to operably couple to an inlet of a transfer pump, a second fitting configured to operably couple to an outlet of the transfer pump, a conduit fluidly coupled between the first fitting and the second fitting, the conduit being configured to transport a fluid, a valve disposed within the conduit, the valve being operable between an open position and a closed position, and an attachment bypass path defined from the first fitting through the conduit to the second fitting. The transfer pump accessory is operatively connected to at least one of a motor interface and a controller. When the valve is in an open position and a siphon condition has been reached, the fluid will siphon through the attachment bypass path.

Other aspects of the present subject matter will become apparent by consideration of the detailed description and accompanying drawings.

Before any embodiments are explained in detail, it is to be understood that the present subject matter is not limited in its application to the details of construction and the arrangement of components set forth in the following description or illustrated in the following drawings. The present subject matter is capable of other embodiments and of being practiced or of being carried out in various ways.

DETAILED DESCRIPTION

Figure 1:
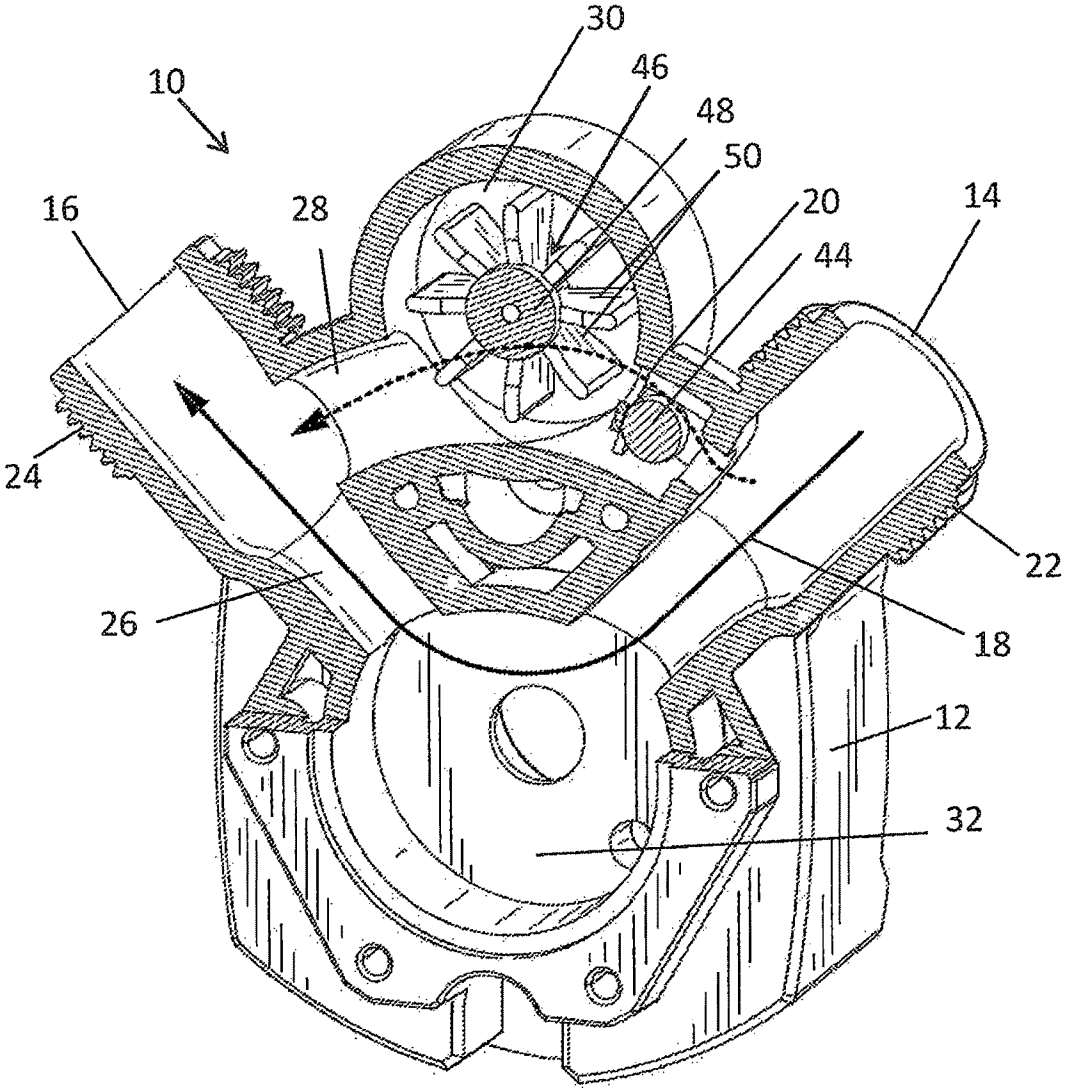
FIG. 1 is a perspective view of a transfer pump body according to one embodiment of the present subject matter.

FIG. 1 illustrates a transfer pump 10, which may also be referred to as a utility pump. The components of the transfer pump 10 are supported by a housing 12, or body. The housing 12 includes an inlet 14, an outlet 16, a main pump path 18 defined in the housing 12 between the inlet 14 and the outlet 16, and a bypass path 20 defined in the housing 12 between the inlet 14 and outlet 16. The transfer pump 10 may include a main housing (not shown) generally enclosing and/or supporting the components of the transfer pump 10 and/or including other features for the transfer pump 10 such as a carrying handle, a hanging apparatus, a base or feet to increase the stability of the transfer pump 10, lubricant, a hose, and additional components (e.g., extra impellers, valves, etc.).

The inlet 14 is fluidly coupled to a source of fluid, such as a liquid medium (e.g., water, mud, oil, and/or the like), that enters the transfer pump 10. The transfer pump 10 is configured for the source of fluid to exit the transfer pump 10 via the outlet 16 by way of pumping the fluid along the main pump path 18 and/or the bypass path 20 as described herein. In the illustrated embodiment, the inlet 14 and outlet 16 are disposed on an upper section of the housing 12. The inlet 14 and outlet 16 may extend from the housing 12 at an angle with respect to each other, e.g., at an angle of between about 30 and about 160 degrees. In the illustrated embodiment, the angle is about 90 degrees. The term "about" is defined herein as plus or minus 10 degrees. In other embodiments, the transfer pump 10 may be constructed with a side discharge outlet and/or the inlet 14 and the outlet 16 may be disposed in different locations or angles with respect to each other, such as about 180 degrees, or any other suitable angle.

The inlet 14 and outlet 16 may include, or be coupled with, respective connectors 22, 24 to allow easy connection of a conduit (not shown), (e.g., a garden hose, pipe, tube, lumen, and/or the like) to the transfer pump 10. In the illustrated embodiment, the inlet 14 and outlet 16 both have threaded hose connectors 22, 24. In the illustrated embodiment, the connectors 22, 24 have external threads that are sized and configured for connection to a standard garden hose or other conduit. In other embodiments, one or both of the connectors 22, 24 may be internally threaded for a standard garden hose or other conduit. In yet other embodiments, the connectors 22, 24 may include quick connectors, cam locks, or other types of connection mechanisms. Additionally, the inlet 14 and outlet 16 not have the same type or configuration of connector.

The main pump path 18 is defined in the housing 12 by or between the inlet 14, the outlet 16, and a main channel 26, which fluidly connects the inlet 14 and the outlet 16. The bypass path 20 is defined in the housing 12 by or between the inlet 14, the outlet 16, and a bypass channel 28, which may be disposed in parallel with the main channel 26. In the illustrated embodiment, the bypass path 20 is disposed above the main pump path 18 within the housing 12. In other embodiments, the bypass path 20 may be disposed below the main pump path 18. Generally, the bypass path 20 is disposed horizontally, or approximately horizontally (e.g., within 30 degrees of horizontal), through the transfer pump 10. In other embodiments, the bypass path 20 may have other orientations, shapes, and/or configurations.

The housing 12 further defines a metering cavity 30 in fluid communication with the bypass path 20 for gauging a fluid flow through the pump and an impeller cavity 32 for receiving a motor impeller (as will be described in greater detail below) in fluid communication with the main pump path 18.

Figure 2:
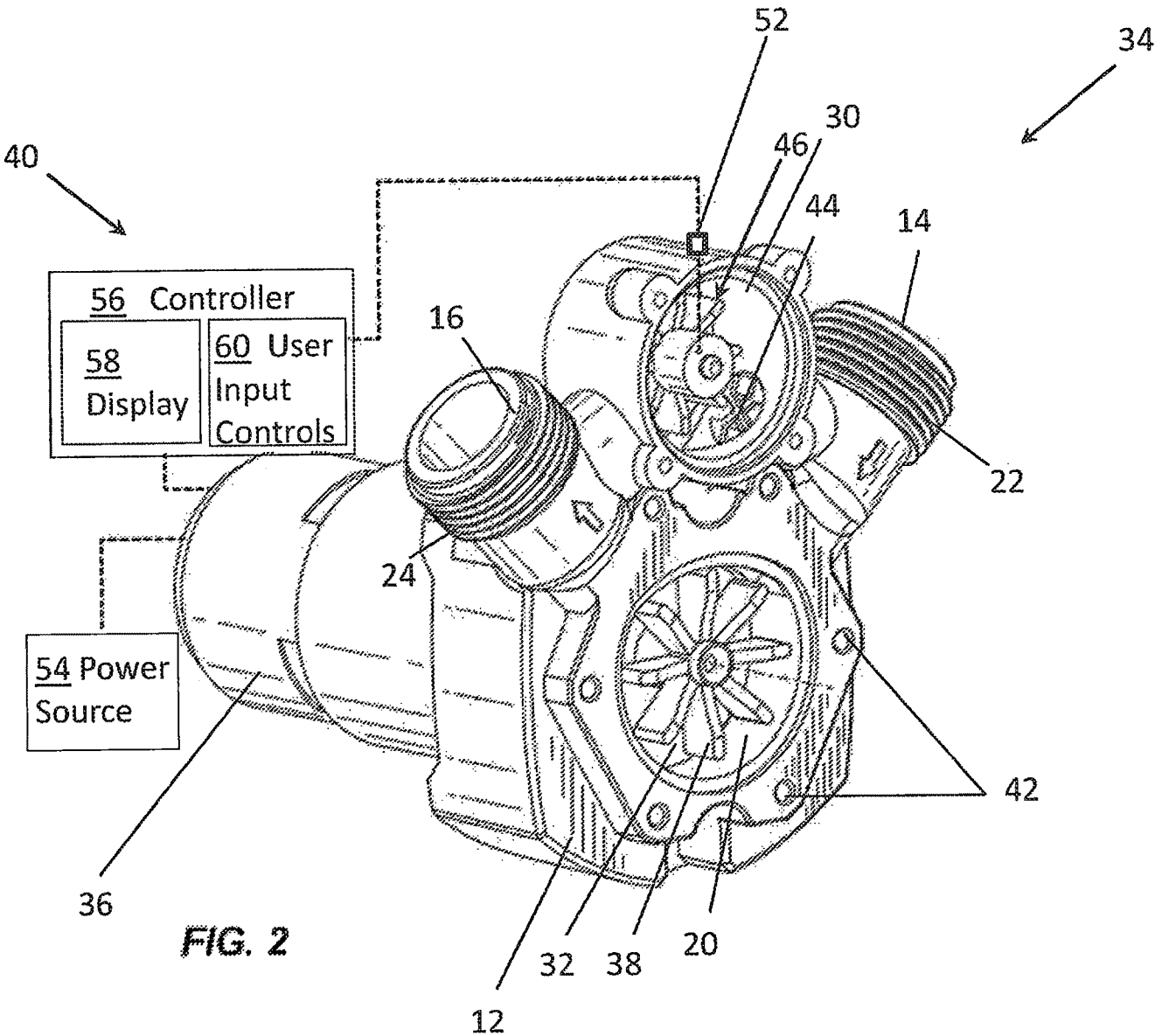
FIG. 2 is a perspective and schematic view of a transfer pump system including the transfer pump body of FIG. 1 with a motor, a power source, and controller operatively coupled thereto.

FIG. 2 illustrates a transfer pump system 34 including the transfer pump 10 with a motor 36 having an impeller 38 disposed in the main pump path 18 for moving the fluid, and a control system 40, which is described in greater detail below. In the illustrated embodiment, the motor 36 is coupled to the housing 12 by fasteners (not shown) positioned through apertures 42 formed in the housing 12. The impeller 38 is disposed in the impeller cavity 32. In other embodiments, the motor 36 may be coupled to the housing 12 by a fitting, support, or other connection means.

A one-way valve 44, or check valve, may be disposed in the bypass path 20 (e.g., in the metering cavity 30) to allow fluid to flow through the bypass path 20 in a direction from the inlet 14 towards the outlet 16 and to inhibit the flow of fluid in an opposite direction, i.e., from the outlet 16 towards the inlet 14. In this way, the one-way valve 44 may inhibit backflow. In the illustrated embodiment, the one-way valve 44 may be disposed in the upstream half of the bypass path 20, closer to the inlet 14 than to the outlet 16. In other embodiments, the one-way valve 44 may be disposed at any location within the bypass path 20, e.g., in the downstream half closer to the outlet 16 than to the inlet 14, proximate to the middle of the bypass path 20, and/or the like.

A flow sensor 46 may be disposed within the metering cavity 30 of the bypass path 20. The flow sensor 46 is configured to measure, or detect, a rate (e.g., a flow rate) at which the fluid flows between the inlet 14 and the outlet 16 through the bypass path 20. In the illustrated embodiment, the flow sensor 46 may be disposed approximately midway between the inlet 14 and outlet 16 in the bypass path 20, but may be disposed in the upstream half or the downstream half of the bypass path 20 in other embodiments. In yet other embodiments, the flow sensor 46 may be disposed in the main pump path 18 or disposed anywhere between the inlet 14 and the outlet 16 for sensing the rate of fluid flow therebetween.

The flow sensor 46 may include a paddle wheel that is rotatably mounted in the metering cavity 30 by way of a rotatably mounted hub 48, or shaft, and the flow sensor 46 may include one or more paddle arms 50 extending generally radially from the hub 48. The paddle arms 50 may be arranged around the hub 48 such that the paddle arms 50 are even in number, odd in number, spaced equidistant around the hub 48, spaced non-equidistant around the hub 48, and/or the like. The flow sensor 46 may include one or more magnetic elements (not shown) cooperating with a Hall Effect sensor 52, such that the Hall Effect sensor 52 may be used to determine the rate at which the fluid is flowing through the bypass path 20 and generate a flow rate signal indicative of the same. The one or more magnetic elements (e.g., magnets) may be disposed on the flow sensor 46 (e.g., by way of magnet(s) mounted on a paddle arm 50, the hub 48, and/or the like), may be integrated with the flow sensor 46 (e.g., by way of magnet(s) being integrally molded inside a paddle arm 50, the hub 48, and/or the like), and/or the like. In this way, the Hall Effect sensor 52 may generate a flow rate signal indicative of the rate at which fluid is flowing through the bypass path 20 based on determining a count, a speed, a rate, and/or the like at which the magnetic element(s) move in response to the fluid flowing through the bypass path 20. In some embodiments, a portion of the hub 48 and/or one or more of the paddle arms 50 may be formed from a magnetic material. In other embodiments, the flow sensor 46 may include a polarized magnetic collar disposed on the paddle wheel's spinning hub 48, or shaft. In yet other embodiments, the flow sensor 46 may include other flow rate sensing mechanisms (e.g., flow meters) for determining the flow rate of the fluid flowing between the inlet 14 and the outlet 16. Additionally, the flow sensor 46 may be disposed in any part of the bypass path 20 for measuring the flow rate of the fluid flowing through the bypass path 20.

A power source 54 is operatively connected to the motor 36 and provides power thereto. The power source 54 may additionally supply power to the flow sensor 46, in cases where the flow sensor 46 is electric. In some embodiments, the power source 54 includes an interchangeable and rechargeable battery pack. The battery pack may provide a direct current electrical power supply to the motor 36 and may include one or more battery cells. For example, the battery pack may be a 12-volt battery pack and may include three (3) Lithium-ion battery cells. In other embodiments, the battery pack may include fewer or more battery cells such that the battery pack is a 14.4-volt battery pack, an 18-volt battery pack, or the like. Additionally, or alternatively, the battery cells may have chemistries other than Lithium-ion such as, for example, Nickel Cadmium, Nickel Metal-Hydride, or the like. The power source 54 may additionally or alternatively include a cord providing an alternating current power supply, e.g., from a utility source such as a standard outlet, and may include a transformer as necessary. In other embodiments, the motor 36 may be powered by other sources such as oil, gas, a fuel cell, a solar cell, combinations thereof, and/or the like.

A controller 56 is operatively coupled to the motor 36, the flow sensor 46, and/or the power source 54 to control activation and deactivation of the motor 36 based on flow rate signals obtained from the flow sensor 46 as described herein. In this way, the controller 56 may cause the pump to perform a pumping process in a motorized state/mode or a non-motorized state/mode (e.g., a bypass mode) based on evaluating the flow rate signals from the flow sensor 46. In this way, the motor may be activated to improve the pumping process in some embodiments, and the motor may be deactivated to conserve energy, reduce waste, decrease noise, and/or the like in some embodiments as described herein.

The controller 56 is operatively coupled to be in communication with the flow sensor 46, to receive one or more flow rate signals from the flow sensor 46. In this way, the controller 56 may cause the transfer pump 10 to function in the motorized mode or the bypass mode based on comparing the flow rate signals obtained from the flow sensor 46 to one or more thresholds as described herein. In some embodiments, the controller 56 may be operatively coupled to the flow sensor 46 by way of a wired connection, a wireless connection (e.g., a Wi-Fi connection), and/or any other suitable connection. In the illustrated embodiment, the controller 56 is an electronic controller, but in other embodiments may include analog or mechanical control systems.

In some embodiments, the controller 56 includes a programmable processor implemented in hardware, firmware, or a combination of hardware and software for implementing the motorized mode, the bypass mode, or a system disable mode. The processor is a central processing unit (CPU), a graphics processing unit (GPU), an accelerated processing unit (APU), a microprocessor, a microcontroller, a digital signal processor (DSP) a field-programmable gate array (FPGA), an application-specific integrated circuit (ASIC), or another type of processing component. The controller 56 additionally includes a memory, and the processor includes one or more processors capable of being programmed to perform a function or mode. The memory may include, for example, a program storage area and a data storage area. The program storage area and the data storage area can include combinations of different types of memory, such as read-only memory ("ROM"), random access memory ("RAM") (e.g., dynamic RAM ["DRAM"], synchronous DRAM ["SDRAM"], etc.), electrically erasable programmable read-only memory ("EEPROM"), flash memory, a hard disk, an SD card, or other suitable magnetic, optical, physical, electronic memory devices, or other data structures. The controller 56 may also, or alternatively, include integrated circuits and/or analog devices, e.g., transistors, comparators, operational amplifiers, etc., to execute logic described below with respect to FIG. 5.

The controller 56 may perform one or more processes described herein. The controller 56 may perform these processes based on the processor executing software instructions stored by a non-transitory computer-readable medium, such as the memory. A computer-readable medium is defined herein as a non-transitory memory device. A memory device includes memory space within a single physical storage device or memory space spread across multiple physical storage devices. Software instructions may be read into the memory from another computer-readable medium or from another device via a communication interface (e.g., a transceiver, a receiver, and/or the like). When executed, the software instructions stored in the memory may cause the processor to perform one or more processes described herein. Additionally, or alternatively, hardwired circuitry may be used in place of or in combination with software instructions to perform one or more processes described herein. Thus, implementations described herein are not limited to any specific combination of hardware circuitry and software.

Still referring to FIG. 2, and in some embodiments, the transfer pump 10 may also include a display 58 and one or more user input controls 60. The display 58 may include a user interface such as a screen, a graphical user interface (GUI), and/or the like. The display 58 may be configured to display various information associated with and/or relating to the transfer pump 10, such as an operational mode of the transfer pump 10, an error associated with the transfer pump 10, and/or the like. The user input controls 60 may include one or more of a touch screen control, a push-button control, a rotatable knob-type control, a switch, and/or the like. The user input controls 60 may facilitate user interaction with the transfer pump 10, whereby a user may instruct the transfer pump 10 to turn on/off, perform a pumping process at a certain rate, and/or the like.

Figure 3B:
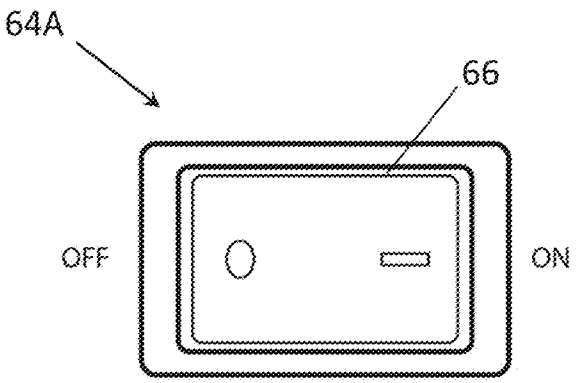
FIG. 3B-3D are plan views of example input controls for the system of FIG. 2.
Figure 3D:
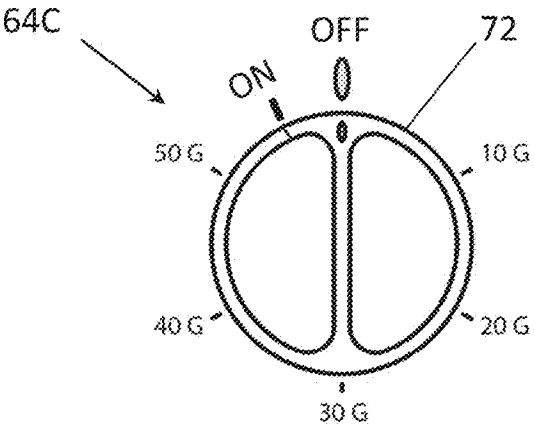
Figure 3A:
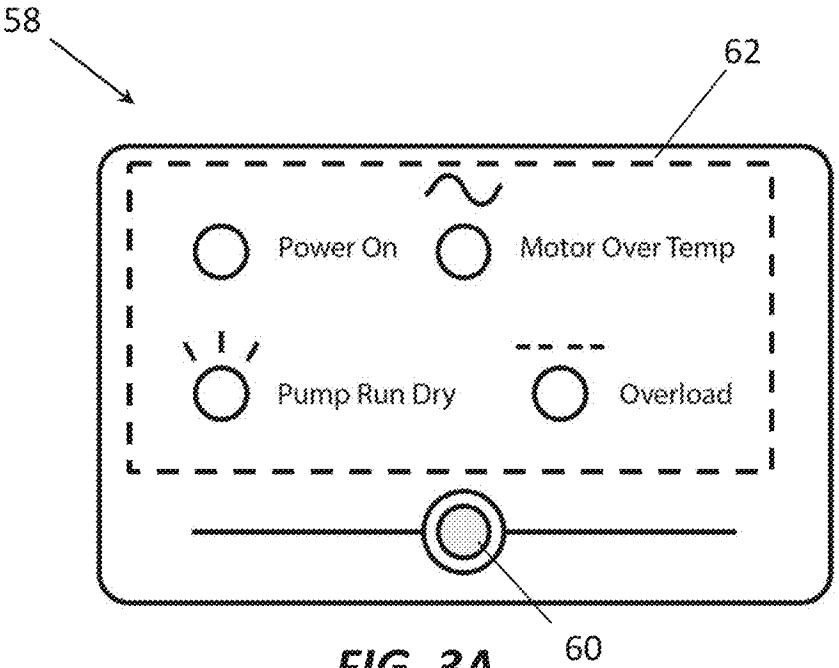
FIG. 3A is a plan view of an example display for the system of FIG. 2.

Referring now to FIG. 3A, an example display 58 and user control 60 is shown. In the illustrated embodiment, the display 58 includes an indicator light 60, such as an LED or other suitable type of light, and a legend or key 62 for associating the meaning of a behavior exhibited by the indicator light 60 with a particular status and/or error. For example, as illustrated in the key 62, the indicator light 60 may (1) emit continuous illumination to indicate the power is ON to the transfer pump 10, (2) emit sinusoidal illumination and dimming to indicate the motor 36 is over temperature, (3) flash on and off to indicate that the pump has run dry, and/or (4) emit two flashes and a pause (on repeat) to indicate a pump overload. In other embodiments, the display 58 may include any other keys employing any other suitable indication behaviors, or any other suitable indication system for communicating status and/or errors to the user, such as individual lights for each status and/or error, a screen displaying words, symbols, or other indicia communicating the status and/or error, a speaker audibly communicating the status and/or error, or any other suitable form of communication.

Figure 3C:
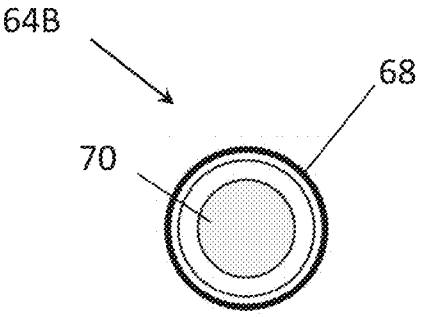

FIG. 3B-3D illustrate example user input controls 64A-64C, which may be provided on the transfer pump 10. For example, a first input control 64A may be an ON/OFF switch 66, which is manually engageable and/or actuatable by an user to turn the transfer pump 10 ON or OFF. FIG. 3C illustrates a second input control 64B, which may include a manually actuatable slidable bypass mode selector 68 or a push-button bypass mode selector 70, for manually turning ON and OFF a bypass mode of the controller 56 to respectively disengage and engage the motor 36. In other cases, as described below, the bypass mode may be automatically implemented by the controller 56. FIG. 3D illustrates a third input control 64C, which may include a rotatable selector 72 knob or turn dial for inputting a desired quantity of water to be transferred during use of the transfer pump 10. In the illustrated embodiments, the input controls may include one or more of a rocker switch, a push button, a turn dial, and/or any combination thereof. Other types of input controls (e.g., a toggle switch, a capacitive touch sensor, a resistive touch sensor, another type of touch sensor, a touch sensor integrated into a display screen, a selector, and/or the like) are contemplated. Such input controls may be disposed on the transfer pump 10 in any desired arrangement or location for allowing a user to interact with the transfer pump 10 to turn the pump on/off, transfer fluid, and/or the like.

In some embodiments, the third input control 64C, illustrated in FIG. 3D, may allow the user to select a desired quantity of water to be transferred before the transfer pump 10 is automatically turned off. The transfer pump 10 may also include OFF and ON setting, where the ON setting may include an unlimited time duration and/or volumetric throughput duration. In this way, the selector 72 may be operatively coupled to the controller 56 to send a signal to the controller 56 indicative of the desired amount of water such that the controller 56 is programmed to turn off the transfer pump 10 when the inputted desired amount of water is transferred through the pump, as measured by the flow sensor 46. For example, as illustrated, the selector 72 provides indicia (e.g., a scale) of selectable water quantities, e.g., 10 gallons, 20 gallons, 30 gallons, 40 gallons, 50 gallons, etc., and an infinite run time (e.g., ON). Other desirable quantities and/or indicia may be employed in other embodiments. The scale may be continuous, allowing the user to select values in between the indicia on the selector 72, or discrete. In other embodiments, the selector 72 may be based on motor 36 run time rather than quantity of water. Also, in other embodiments, the selector may include other forms, such as a slider, up/down selector buttons and an indicator for an amount selected, or the like, or be part of an input device, such as a display screen having a touch sensor.

Figure 4:
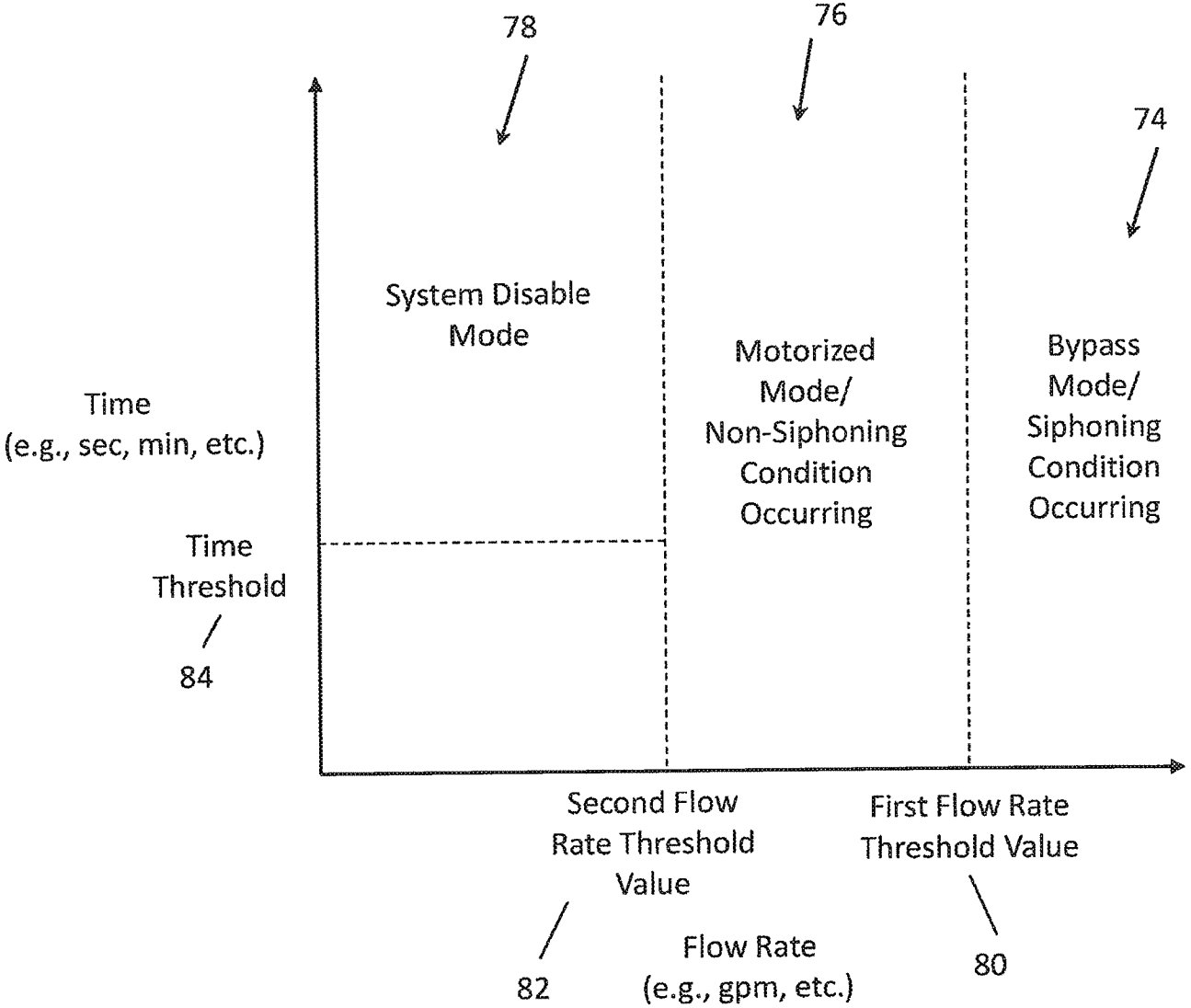
FIG. 4 illustrates modes initiated by the controller based on a relationship between a flow rate and an operation time of the transfer pump.

FIG. 4 illustrates various modes of operating the transfer pump 10 that may be implemented by the controller 56. The various modes may be based on the controller 56 determining that a flow rate of the fluid passing through the transfer pump 10 (e.g., as measured by the flow sensor 46) satisfies a threshold, or based on the controller 56 determining that a flow rate of the fluid passing through the transfer pump 10 in combination with an operation time (e.g., as measured by an onboard clock that is included with and/or communicatively coupled to the controller 56, not shown) satisfies one or more thresholds. The controller 56 is configured to determine or detect a variety of conditions based on flow rates and/or operation times, which allows the controller 56 to determine whether to operate the transfer pump 10 in a (i) a bypass mode 74, (ii) a motorized mode 76, or (ii) a system disable mode 78 as described herein.

In the bypass mode 74, the motor 36 is OFF (de-energized, disengaged, and/or the like), as the controller 56 may determine the flow rate of the fluid passing through the transfer pump 10 to be associated with a siphoning condition in which the fluid may pass through the transfer pump 10 without having to engage the motor 36. In this way, cost and/or energy savings may be realized. In the motorized mode 76, the motor 36 is ON (e.g., engaged, energized, and/or the like), as the controller 56 may determine the flow rate of the fluid passing through the transfer pump to be associated with a non-siphoning condition in which the motor may be required to pump the fluid through the transfer pump 10. In the system disable mode 78, the system 34 may be disabled as the controller 56 may determine that the rate of fluid flowing through the system 34 may be so low during a predetermined time threshold that the controller 56 disables the system. In this way, the lifetime of the transfer pump 10 may improve.

In some embodiments, the controller 56 is configured to determine the mode of operability of the transfer pump. For example, the transfer pump 10 may cause the transfer pump 10 to operate in the bypass mode 74 upon disabling of the motor 36 when one or more bypass conditions are satisfied. In the illustrated embodiment, a bypass condition may include a flow rate (e.g., or a flow rate signal) satisfying a first flow rate threshold 80. The first flow rate threshold 80 may be a predetermined flow rate level or value at or above which it is determined that the fluid automatically siphons through the pump (e.g., through the bypass path 20) without having to engage the motor 36. The controller 56 is configured to detect when the siphoning condition occurs based on obtaining an indication of the flow rate from the flow sensor 46 and comparing the flow rate to the first flow rate threshold, and operate the transfer pump 10 in the bypass mode 74 via turning off the motor 36. In this way, energy may be conserved, the pump motor 36/impeller 38 may be protected from undue damage or wear, operating conditions (e.g., noise level, etc.) may be improved, and/or the like. In this way, the fluid transfer may rely on a siphoning condition occurring between the inlet 14 and outlet 16. When in the bypass mode, the fluid may flow (e.g., siphon) through both the primary path 18 and the bypass path 20, or the fluid may flow only the bypass path 20, as desired.

In some embodiments, the controller 56 is configured to cause the transfer pump 10 to operate in the motorized mode 76 when one or more motorized mode conditions or non-siphoning conditions are satisfied. In the illustrated embodiment, a non-siphoning condition may include a flow rate (e.g., or a flow rate signal) failing to satisfy the first flow rate threshold 80. The controller 56 is configured to detect when the non-siphoning condition occurs and operate the transfer pump 10 in the motorized mode 76 via turning the motor 36 on and/or continuing to engage the motor 36. Additionally, or alternatively, one or more of the non-siphoning conditions may be associated with the flow rate and/or the flow rate signal falling between the first flow rate threshold 80 and a second flow rate threshold 82. The controller 56 may be configured to operate the transfer pump such that the operation modes automatically fluctuate between the motorized mode 76 (e.g., energizing the motor) and the bypass mode 74 (e.g., de-energizing the motor) based on fluctuations in a flow rate of fluid passing between the inlet 14 and outlet 16. In this way, energy may be conserved, the pump motor 36/impeller 38 may be protected from undue damage or wear, operating conditions (e.g., noise level, etc.) may be improved, and/or the like. When in the motorized mode, the fluid may flow (e.g., pump) through both the primary path 18 and the bypass path 20, or the fluid may only be pumped through the primary path 18, as desired.

In some embodiments, the controller 56 is configured to cause the transfer pump to enter the system disabled mode when one or more system disable mode conditions are satisfied. In the illustrated embodiment, a system disable mode condition may include a flow rate fails to satisfy a flow rate threshold (e.g., the second flow rate threshold 82, which may correspond to a minimum flow rate value) and/or a time threshold 84 being satisfied. A clock or timer (not shown) may be used by the controller 56 to monitor time and determine whether the time threshold 84 has been reached. The time threshold 84 may, for example, be about 10 seconds or more, about 30 seconds or more, or any other suitable amount of time in other embodiments, such as less than 10 seconds, or more than 30 seconds. The controller 56 is configured to detect when the system disable mode conditions occur and operate the system in the system disabled mode by automatically powering off the transfer pump 10 and/or system 34. In this way, the degree of safety associated with operating a pump may improve. Additionally, undue damage to the pump may be prevented and, thus, the lifetime of the transfer pump 10 may be extended. When in the system disable mode, fluid may be inhibited from passing through the primary path 18 and the bypass path 20.

Figure 5:
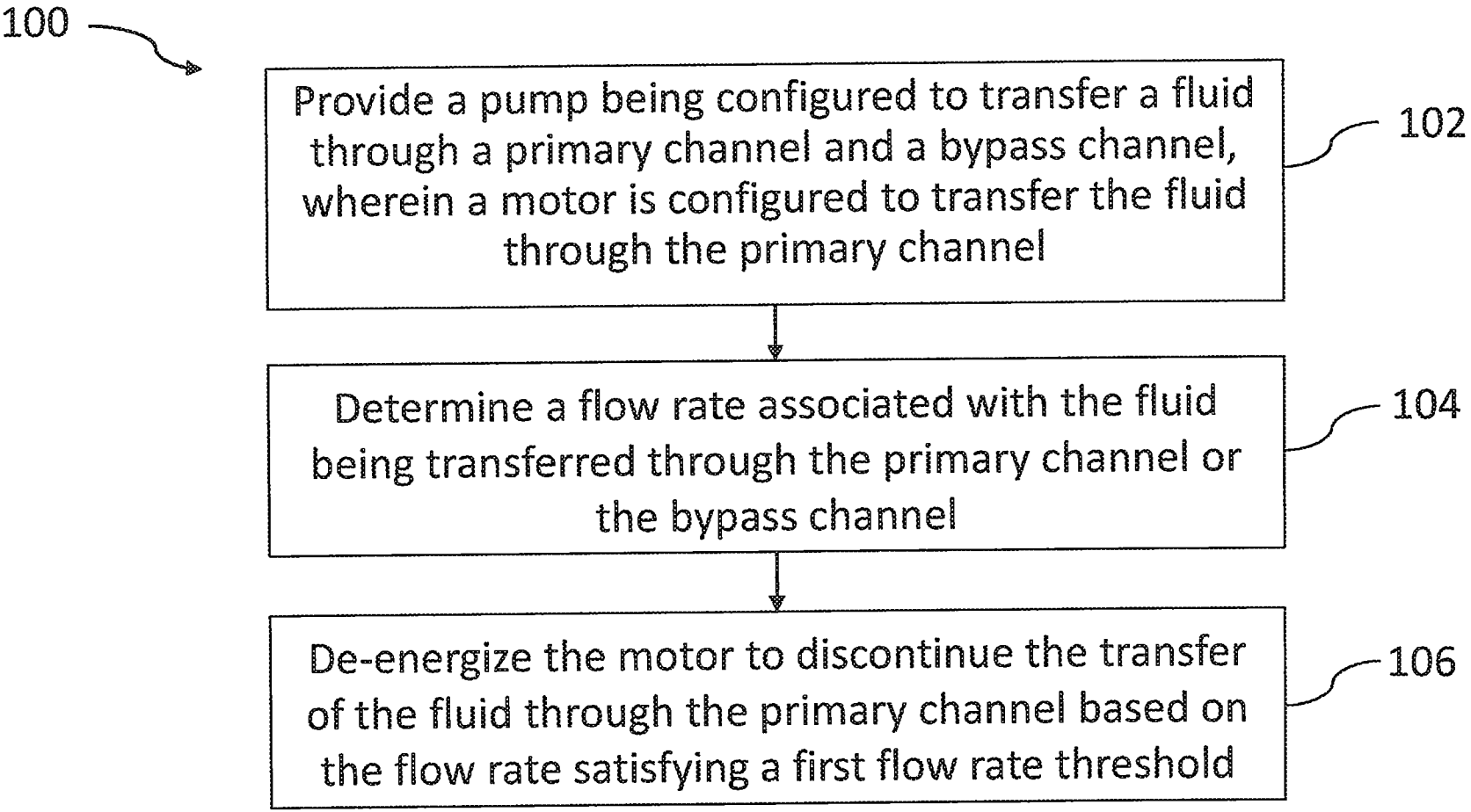
FIG. 5 is a flow chart illustrating a method of transferring fluid via the transfer pump of FIG. 1 and/or the system of FIG. 2.

FIG. 5 illustrates a flow chart of a method 100 for the selective operation of transfer pump 10 and/or components (e.g., motor, impeller, and/or the like) thereof. The transfer pump 10 is provided, which is configured to transfer a fluid through the main pump path 18 and the bypass path 20. At start-up, the controller 56 is configured to cause the motor 36 to transfer the fluid through the main pump path 18 (block 102). The controller 56 determines a flow rate associated with the fluid being transferred through the main pump path 18 or the bypass path 20 (block 104). The controller 56 turns the motor 36 OFF to discontinue transfer of the fluid through the main pump path 18 based on the flow rate satisfying the first flow rate threshold 80 (block 106). The controller 56 may implement logic that determines when to enter the bypass mode 74, the motorized mode 76, and/or the system disable mode 78, as described herein. The controller 56 may cause the transfer pump 10 to fluctuate between the various modes as described herein, based on determining conditions satisfying various flow rate thresholds and/or timing thresholds.

The flow sensor 46 may continuously (which may include periodically or intermittently) monitor a flow rate of fluid passing through the transfer pump 10 and send signals, i.e., data, to the controller 56 for determining when to energize and de-energize the motor 36 to continue and discontinue the transfer of the fluid through the main pump path 18 based on the flow rate satisfying a first flow rate threshold 80. Thus, the transfer pump 10 saves energy by de-energizing the motor 36 when a natural siphoning condition does the work to transfer the fluid and the motor 36 is not needed, and re-energizes the motor 36 when the siphoning condition ends to provide forced fluid transfer.

In operation, a first hose (not shown) may be coupled to the inlet 14 and a second hose (not shown) may be coupled to the outlet 16. When the user turns the transfer pump 10 ON, the controller 56 activates or energizes the motor 36. The energized motor 36 begins transferring fluid through the main pump path 18, and fluid may also pass through the bypass path 20 in parallel with the main pump path 18. When a siphoning condition occurs, as indicated by the flow rate signal from the flow sensor 46 being at or above the first flow rate threshold 80, the controller 56 may de-activate the motor 36. When the siphoning condition ends, as indicated by the flow rate signal from the flow sensor 46 dropping to or below the first flow rate threshold 80, the controller 56 may re-activate the motor 36 to improve the flow rate and encourage re-establishment of a siphoning condition. To reduce overheating of the motor 36, a time threshold 84 may be applied to limit the run time of the motor 36 while attempting to induce a siphon. In some embodiments, the user may choose to operate the transfer pump 10 in a conventional manner (e.g., the motor 36 turning ON or OFF based on the switch 66) by turning OFF the bypass mode (e.g., FIG. 3C) by way of manually actuating the bypass selector 68.

Figure 6:
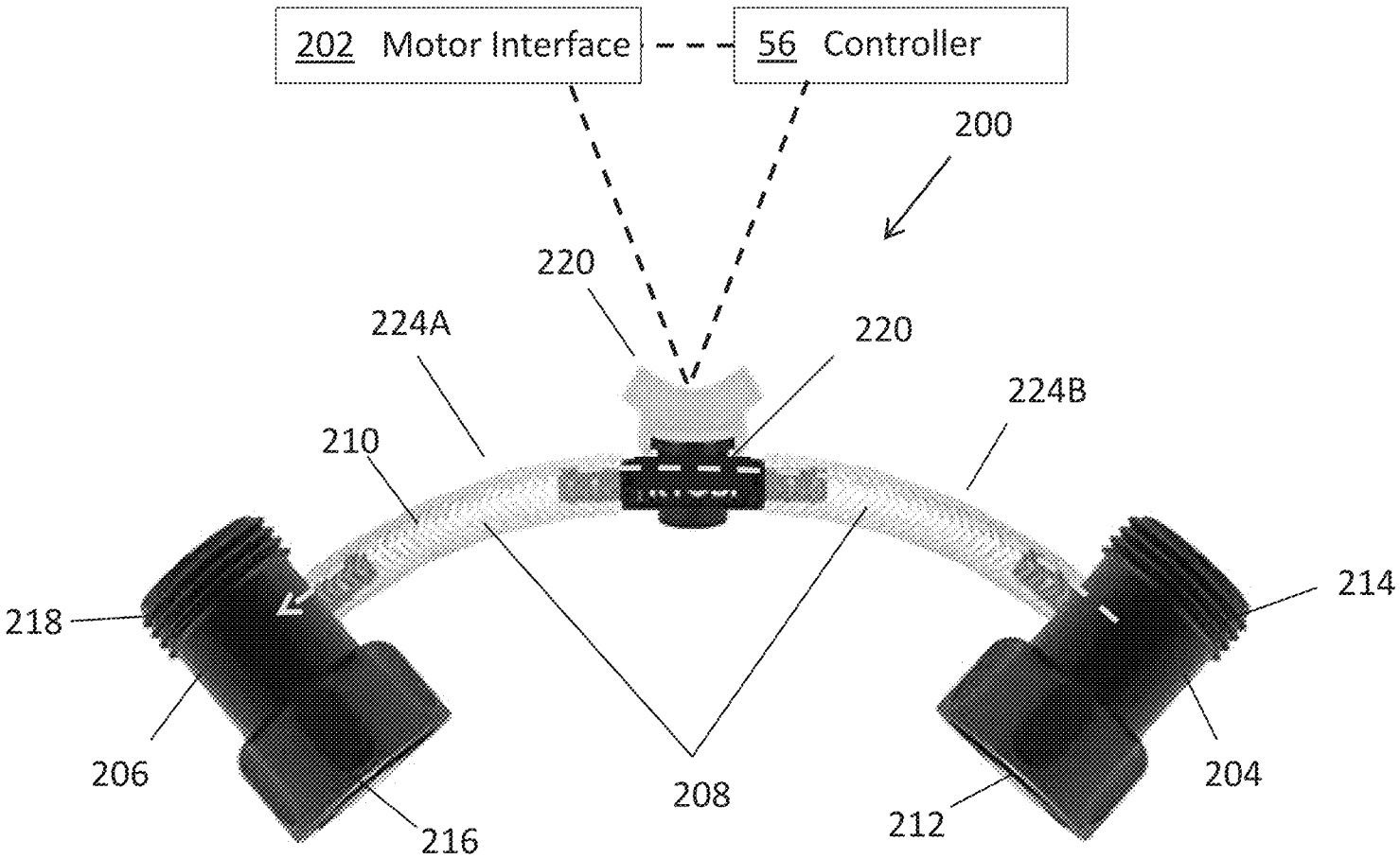
FIG. 6 is a side view of a bypass attachment accessory for a standard transfer pump in accordance with another embodiment of the present subject matter.

FIG. 6 illustrates a bypass attachment 200, which is a retrofittable transfer pump accessory that is coupleable to a standard transfer pump (e.g., a transfer pump such as the one shown and described in FIG. 2, but not having bypass path functionality integrated therein). The bypass attachment 200 may operate similar to the bypass path 20 and components therein (e.g., flow sensor 46, valve 44, and/or the like) as described above, and may be operatively connected to at least one of a motor interface 202 and the controller 56, whereby the controller 56 may selectively control the motor 36 (e.g., energized or de-energize the motor 36) based on a flow rate of fluid passing through the bypass attachment 200. The bypass attachment 200 may be operatively connected to at least one of the controller 56 and the motor interface 202 via a wired connection, wireless connection and/or the like. The operative connection allows the bypass attachment 200 to communicate with the controller 56 and/or motor interface 202 to cause the transfer pump to selectively enter a bypass mode or a motorized mode. In the bypass mode, the motor 36 of the transfer pump may be de-energized to conserve energy and facilitate other benefits described above. In the motorized mode, the motor 36 of the transfer pump may be energized and operate similar to that of a standard transfer pump.

The bypass attachment 200 may include a first fitting 204, a second fitting 206, and a conduit 208 fluidly coupled between the first fitting 204 and the second fitting 206. An attachment bypass path 210 is defined by or between the first fitting 204, the conduit 208, and the second fitting 206. The first fitting 204 may include a first inner threaded surface 212 configured to be coupled to the inlet (e.g., similar to the inlet 14 illustrated in FIG. 1) of the standard transfer pump. The first fitting 204 also includes a first outer threaded surface 214 configured to be coupled to a hose, such as a garden hose. The second fitting 206 includes a second inner threaded surface 216 configured to be coupled to the outlet (e.g., similar to the outlet 16 illustrated in FIG. 1) of the standard transfer pump. The first fitting 204 may include a second outer threaded surface 218 configured to be coupled to another conduit, such as a garden hose.

The bypass attachment 200 may additionally include a valve actuator 220, such as a knob (e.g., a wing knob), operatively coupled to allow a user to selectively open and close a valve 222 disposed in the conduit 208. The valve 222 may include a butterfly valve, or any other suitable valve capable of assuming an open position and a closed position. When the valve 222 is in an open position, fluid may pass through the valve 222 and thus through the conduit 208. When the valve 222 is in a closed position, the fluid is inhibited from passing through the valve 222 and thus is inhibited from passing through the conduit 208. In other embodiments, other types of actuators for opening and closing the valve 222 may be employed.

In the illustrated embodiment, the conduit 208 is formed from multiple separate conduit portions 224A, 224B; however, in other embodiments, the conduit 208 may be formed as a single piece. In some embodiments, the bypass attachment 200 may include a one-way valve (not shown), such as the one-way valve 44 described above and shown in FIG. 1, for inhibiting backflow. The one-way valve (not shown) may be disposed anywhere in the bypass attachment 200, such as in the first fitting 204, in the conduit 208, or in the second fitting 206. In other embodiments, the valve 222 may inhibit backflow with the one-way feature integrated therein.

In operation, the user may retrofit the standard transfer pump with the bypass attachment 200 by coupling the first fitting 204 to the standard transfer pump inlet (e.g., similar to the inlet 14 illustrated in FIG. 1) and coupling the second fitting 206 to the standard transfer pump outlet (e.g., similar to the outlet 16 illustrated in FIG. 1) such that the conduit 208 extends between the first and second fittings 204, 206. The user may monitor the standard transfer pump and manually actuate the valve actuator 220 to position the valve 222 in the open position, thus manually turning the motor (e.g., the motor 36) OFF, e.g., by actuating a switch (such as the switch 66). When the valve 222 is in an open position and if a siphon condition has been reached, the fluid will siphon through the attachment bypass path 210, thus saving motor and/or battery life.

In yet another embodiment, the bypass attachment 200 may be integrated into the standard transfer pump. Thus, the transfer pump (not shown) includes a bypass path (e.g., similar to the bypass path 20) integrated into the housing (e.g., as illustrated in FIG. 1) and has a manually-actuatable valve (such as the valve 222 and valve actuator 220 illustrated in FIG. 6) disposed in the bypass path instead of the flow sensor 46. Thus, the transfer pump is manually actuatable as described above with respect to FIG. 6 to open and close the bypass path and manually turn the motor (e.g., the motor 36) ON and OFF to save power during a siphoning condition.

The disclosure herein provides, among other things, a transfer pump 10 and a bypass attachment 200 that reduce energy consumption by de-energizing the motor 36 during natural siphoning conditions.

Some implementations are described herein in connection with thresholds. As used herein, satisfying a threshold may refer to a value being greater than the threshold, more than the threshold, higher than a threshold, greater than or equal to a threshold, less than the threshold, fewer than the threshold, lower than the threshold, less than or equal to the threshold, equal to the threshold, or the like.

Various features and advantages of the present subject matter are set forth in the following claims.

The invention claimed is:

1. A transfer pump comprising:

a housing defining an inlet and an outlet;

a main pump path disposed between the inlet and the outlet;

a bypass path disposed between the inlet and the outlet;

a motor having an impeller in fluid communication with the main pump path, the motor being configured to be selectively energized to move a fluid through the main pump path and the bypass path, and the fluid movement while the motor is energized being indicative of a non-siphoning condition occurring between the inlet and the outlet;

a flow sensor disposed in fluid communication with the bypass path, the flow sensor being configured to generate a flow rate signal indicative of a flow rate of fluid in the bypass path; and a controller in communication with the flow sensor for receiving the flow rate signal, the controller being configured to de-energize the motor when the flow rate signal satisfies a first flow rate threshold indicative of a siphoning condition occurring between the inlet and the outlet, the fluid flow passing through the bypass path while the controller determines the siphoning condition is occurring.

2. The transfer pump of claim 1, further comprising an inlet connector and an outlet connector, at least one of which is configured to be coupled with a conduit.

3. The transfer pump of claim 1, wherein the controller is configured to continuously monitor the flow rate signal during operation.

4. The transfer pump of claim 1, wherein the flow sensor includes:

a magnetic element, and a Hall Effect sensor in cooperation with the magnetic element, the Hall Effect sensor being configured to measure the flow rate of fluid in the bypass path.

5. The transfer pump of claim 4, wherein:

the flow sensor further includes a paddle wheel, and the paddle wheel includes the magnetic element.

6. The transfer pump of claim 1, wherein the controller is further configured to energize the motor when the flow rate signal drops at or below a second flow rate threshold indicative of a non-siphoning condition.

7. The transfer pump of claim 1, further comprising a one-way valve disposed in the bypass path to inhibit backflow.

8. The transfer pump of claim 1, wherein the controller is further configured to disable the operation of the transfer pump when the flow rate signal drops at or below a second flow rate threshold and satisfies a time threshold indicative of a system disable mode condition being reached.

9. The transfer pump of claim 1, wherein the controller is configured to fluctuate between energizing the motor and de-energizing the motor when the flow rate signal falls between the first flow rate threshold and a second flow rate threshold.

10. The transfer pump of claim 1, wherein the controller is configured to de-energize the motor when the flow rate signal of the fluid in the bypass path is at or above a flow rate of the fluid in the main pump path.

11. The transfer pump of claim 10, wherein the controller is further configured to energize the motor when the flow signal of the fluid in the bypass path is at or below a second flow rate threshold indicative of a non-siphoning condition.

12. A method of operating a transfer pump, the method comprising:

providing a pump being configured to transfer a fluid through a primary channel and a bypass channel, the pump including a motor being configured to transfer the fluid through the primary channel;

determining a flow rate associated with the fluid being transferred through the primary channel or the bypass channel; and de-energizing the motor to discontinue the transfer of the fluid through the primary channel while fluid flows through the bypass path based on the flow rate satisfying a first flow rate threshold.

13. The method of claim 12 further comprising monitoring the flow rate of the fluid continuously through the bypass channel using a flow sensor.

14. The method of claim 12 further comprising energizing the motor to induce the flow of the fluid through the primary channel based on the flow rate satisfying a second flow rate threshold.

15. The method of claim 12 further comprising disabling the transfer pump based on the flow rate satisfying a second flow rate threshold and satisfying a time threshold.

* * * * *